US006811456B2

(12) United States Patent
Redmon

(10) Patent No.: US 6,811,456 B2
(45) Date of Patent: Nov. 2, 2004

(54) WAKEBOARD AND KITEBOARD WITH CURVED FINS AND METHODS OF USE

(75) Inventor: James J. Redmon, Oceanside, CA (US)

(73) Assignee: Motion Water Sports, Inc., Redmond, WA (US)

( * ) Notice: Subject to any disclaimer, the term of this patent is extended or adjusted under 35 U.S.C. 154(b) by 0 days.

(21) Appl. No.: 10/251,882

(22) Filed: Sep. 23, 2002

(65) Prior Publication Data

US 2003/0166365 A1 Sep. 4, 2003

Related U.S. Application Data

(60) Provisional application No. 60/323,722, filed on Sep. 21, 2001.

(51) Int. Cl.[7] ..... B63B 35/79
(52) U.S. Cl. ..... 441/79; 441/65; 441/74
(58) Field of Search ..... 441/65, 74, 79

(56) References Cited

U.S. PATENT DOCUMENTS 3,380,425 A * 4/1968 Wilson ..... 114/253
5,152,705 A * 10/1992 Rock ..... 441/74
5,273,472 A * 12/1993 Skedeleski et al. ..... 441/79
6,149,479 A 11/2000 Redmon et al. ..... 441/79
6,273,369 B1 * 8/2001 Nishimura et al. ..... 244/155 A

FOREIGN PATENT DOCUMENTS

WO WO99/44884 * 9/1999

* cited by examiner

*Primary Examiner*—Sherman Basinger
(74) *Attorney, Agent, or Firm*—Clark & Brody

(57) ABSTRACT

A water floatation board includes a pair of curved side fins for an increase in holding power of the board when in the matter, and without increasing drag during board use. Each curved side fin has a concave surface that faces a centerline of the board, and a convex surface that is opposite of the concave surface. The inner and outer surfaces merge to form leading and trailing edges, and a fin tip. The use of the concave surface allows the fin area to increase without an increase in fin depth, thus providing greater holding power without increasing drag.

10 Claims, 2 Drawing Sheets

WAKEBOARD AND KITEBOARD WITH CURVED FINS AND METHODS OF USE

This application claims priority under 35 USC 119(e) based on provisional application No. 60/323,722 filed on Sep. 21, 2001.

FIELD OF THE INVENTION

The present invention is directed to a water floatation board and in particular to one with curved fins.

BACKGROUND ART

In the prior art, it is common to use side fins or stabilizers on wakeboards and kiteboards to provide extra control and maneuverability.

FIG. 1 shows a conventional water floatation board 10 with a center fin 3 and a pair of side fins 5. U.S. Pat. No. 6,149,479 to Redmon et al. shows one example of canted side fins. U.S. Pat. No. 5,934,961 shows another type of wakeboard with center fins. These patents are incorporated by reference in their entirety.

On boards where displacement is increased by increasing the plan width of the board, side fins are added to aid in directional control and tracking. As more directional control and tracking are required, the size of the side fins are increased in a depth direction. While improvements are realized with deeper fins, an increase in fin depth causes increases in drag, and the board moves more slowly through the water.

Accordingly, there exists a need to provide water floatation boards with both better control and less drag.

The present invention solves this need by providing a water floatation board that has side fins that offer an increase in holding power without increasing drag.

SUMMARY OF THE INVENTION

It is a first object of the present invention to provide an improved water floatation board.

Another object of the invention is to provide a water floatation board that uses curved side fins for improved control but without an increase in drag.

Other objects and advantages of the present invention will become apparent as a description thereof proceeds.

In satisfaction of the foregoing objects and advantages, the present invention provides improvements in water floatation board by the use of side fins, each employing a concave surface facing the board centerline, and a convex surface as the remaining and opposite fin surface. The concave surface holds more water than a conventional fin without increasing drag via a depth dimension increase. The surface facing a centerline of the board is the concave surface with the fin's opposite surface being the convex one. These two surfaces merge together to form a leading edge, a trailing edge, and a tip.

The water floatation board can be any type of a board such as a wakeboard, a kiteboard, or the like. Each board can be equipped with one set of side fins on one end, or a set of side fins on each end. Further, the board can include a center fin disposed between opposing side fins.

The bottom surface of the board can be profiled in the vicinity of the side fins, if desired.

BRIEF DESCRIPTION OF THE DRAWINGS

Reference is now made to the drawings of the invention wherein.

DESCRIPTION OF THE PREFERRED EMBODIMENTS

The present invention offers significant advantages in the field of water floatation boards, particularly wakeboards and kiteboards by having both increased control and low drag. These apparently divergent properties are attained by using specially shaped or curved side fins.

Each curved side fin features an asymmetrical foil with an inside surface and an outside surface. The inside surface of the fin (a concave surface) is curved inwards along its chord length moving from the base of the fin to the fin tip. The outside surface of the fin (a convex surface) follows a standard foil shape from its leading edge to its trailing edge.

The outside chord of the fin folds over at the fin tip to meet the curve generated by the inside surface.

The curved fin offers an increase in the hold of the fin by its longer chord length along the inside surface. The curved surface causes water to flow across a longer surface than on a standard fin shape of the same depth. The water feels a bigger fin surface along its chord length flow.

At the same time, the actual depth of the fin can be reduced due to this increase in chord length, or the fin depth can be maintained the same. In one instance, with a decreased fin depth, drag is decreased. On the other hand, even when the fin depth stays the same, hold increases without an increase in drag. The end result is a curved fin that provides an increase in hold or control without a corresponding increase in drag as would be the case when merely increasing the fin depth. In some cases, drag is reduced while hold is increased.

The curved fin is able to hold more water for a given space, thus providing better control when the board is passing through water. At the same time, the fin depth remains essentially the same and little drag increase is seen.

Figure 1:
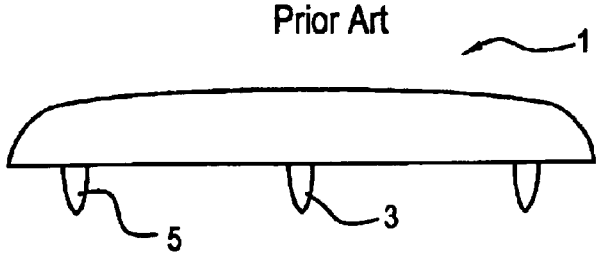
FIG. 1 Prior Art
FIG. 1 shows a conventional fin arrangement for a water floatation board.
Figure 2:
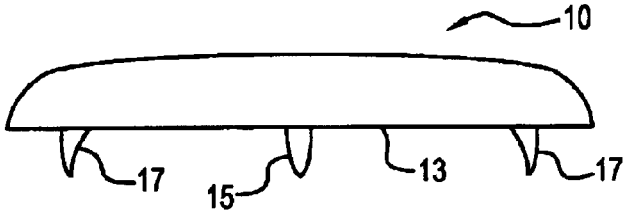
FIG. 2 is an end view of a water floatation board employing side fins according to the invention.
Figure 3:
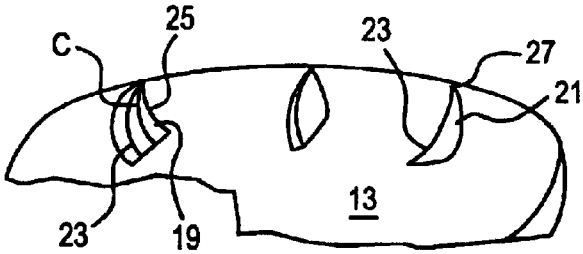
FIG. 3 is a perspective view of the fins of FIG. 3.
Figure 4:
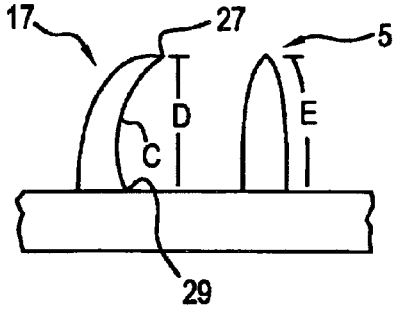
FIG. 4 is a comparison of the inventive curved side fin and a conventional fin to show chord length and depth difference.

Referring now to FIGS. 2–4, a water floatation board 10 is illustrated having a bottom surface 13, a center fin 15, and a pair of side fins 17.

Each side fin 17 has an inner surface 19 and an outer surface 21. The surfaces 19 and 21 merge at a leading edge 23, a trailing edge 25, and a tip 27.

Referring to FIG. 4, the inner surface is concave such that a chord length designated by "C" extending from the base 29 to the tip 27 is greater than the depth of the fin as shown by "D". FIG. 4 also shows that the chord length "C" is greater than the chord length "E" of a conventional fin 3. Consequently, the fin 17 can have the same depth as the conventional fin 5, but with greater holding power due to the chord length "C" being greater than "E." In terms of area, the area of inner surface 19 is greater than the surface area of a conventional fin of the same depth. This greater surface area allows for the better hold without increasing the fin depth and drag as a result thereof.

Figure 5:
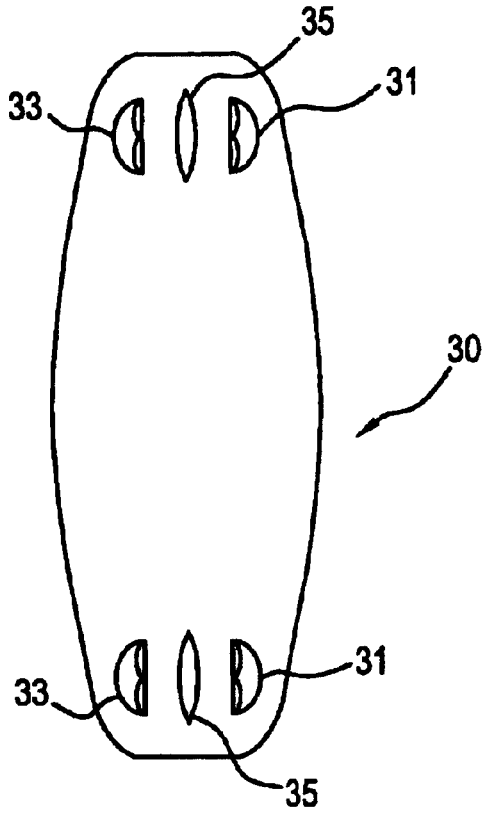
FIG. 5 shows an underside view of a wakeboard, with a center fin and side fins at each end of the board.

FIG. 5 shows an exemplary wakeboard design 30 employing a pair of curved side fins 31 and 33, and a center fin 35 on one end, and another set of curved side fins 31 and center fin 33 at the other end. It should be understood that although the board in FIGS. 1–4 is shown with a flat bottom surface, any type of known bottom surface profile can be used with the water floatation board as is known in the art.

Figure 6:
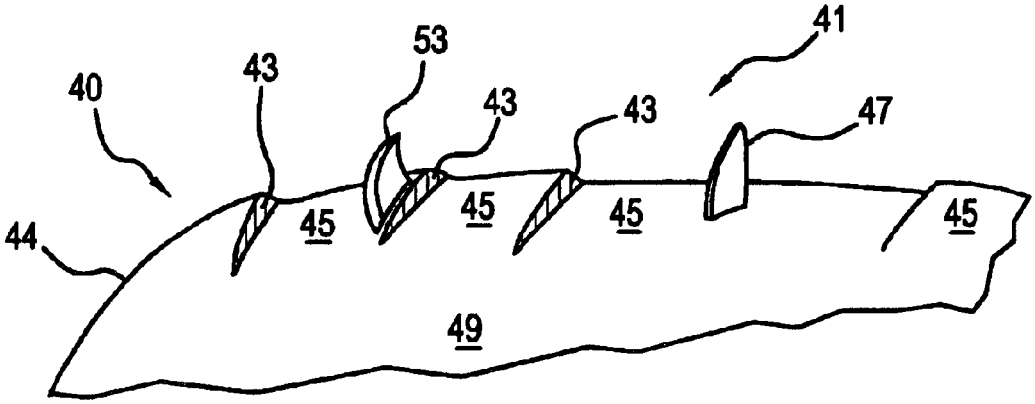
FIG. 6 shows a partial perspective view of an end of a water floatation board showing a particular board profile in combination with the curved side fins.

FIG. 6 shows a partial perspective view of another wakeboard 40 that employs a profiled bottom surface 41 at the board end. That is, a series of steps 43 are shown which extend laterally from the side 44 to the center fin 47. The steps form a series of plateaus 45 which ultimately merge back into a generally flat bottom surface 49. With this profile, the curved side fin 53 is raised with respect to the center fin 47. It should be understood that a similar profile exists for the other half of the board, although not shown.

The curved fins can be used on one end of a board, or the fins could be used on both ends. In each instance, the fins could be used with or without a center fin. The fins can be employed on any type of a water floatation board, but are preferably used on wakeboards, kiteboards, and the like. The boards and fins can have any construction, and the fin and board material construction as well as fin attachment to the board is deemed conventional and not necessary for understanding of the invention.

While the tip is illustrated in a relatively pointed configuration, other sharper or duller tips can be employed. Likewise, the leading and trailing edges could be sharp or more rounded edges.

The board construction is also conventional and comprises a bottom surface, a top surface, side edges a front edge, and a rear edge. The fin pair is mounted such that the concave surfaces face the centerline of the board and each other. If a center fin is used, the center fin can be disposed between the side fins or can be arranged either ahead or behind a line intersecting the side fins. Other arrangements of the fins as would be contemplated by one skilled in the art are also within the scope of the invention. The board surfaces can also include conventional features found in such boards, include known profiles, different materials of construction, different type surfaces, etc.

As such, an invention has been disclosed in terms of preferred embodiments thereof which fulfills each and every one of the objects of the present invention as set forth above and provides new and improved water floatation board with curved fins.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a wakeboard having at least a pair of side fins extending from a bottom surface of the board, the improvement comprising each side fin having a concave surface generally facing a centerline of the board, and a convex outer surface opposite the concave surface, the inner and outer surfaces merging into a leading edge, a trailing edge and a tip, wherein each of the concave and convex surfaces of each side fin extends from an edge of the side fin that meets a bottom surface of the board to the tip, wherein an area of the bottom surface of the wakeboard where the side fins extend from is profiled, the profile further comprising a series of lowering steps extending from a side edge of the wakeboard towards the centerline of the board.

2. The wakeboard of claim 1, further comprising a center fin disposed between the pair of side fins.

3. The wakeboard of claim 1, further comprising a pair of side fins mounted on each end of the wakeboard.

4. The wakeboard of claim 3, further comprising a center fin mounted between each pair of side fins.

5. In a kiteboard having at least a pair of side fins extending from a bottom surface of the board, the improvement comprising each side fin having a concave surface generally facing a centerline of the board, and a convex outer surface opposite the concave surface, the inner and outer surfaces merging into a leading edge, a trailing edge and a tip, wherein each of the concave and convex surfaces of each side fin extends from an edge of the side fin that meets a bottom surface of the board to the tip, wherein an area of the bottom surface of the kiteboard where the side fins extend from is profiled, the profile further comprising a series of lowering steps extending from a side edge of the kiteboard towards the centerline of the board.

6. The kiteboard of claim 5, further comprising a center fin disposed between the pair of side fins.

7. The kiteboard of claim 5, further comprising a pair of side fins mounted on each end of the kiteboard.

8. The kiteboard of claim 7, further comprising a center fin mounted between each pair of side fins.

9. In a method of pulling a wakeboard through water using a watercraft, the improvement comprising pulling the wakeboard of claim 1 by the watercraft.

10. In a method of pulling a kiteboard through water using windpower, the improvement comprising pulling the kiteboard of claim 5 by the windpower.

* * * * *